US007591516B2

(12) United States Patent
Kim et al.

(10) Patent No.: US 7,591,516 B2
(45) Date of Patent: Sep. 22, 2009

(54) DOOR APPARATUS FOR DRAWER TYPE REFRIGERATOR

(75) Inventors: Young-Nam Kim, Changwon (KR); Jee-Suck Lee, Kimhae (KR); Ju-Hwan Kim, Jinhae (KR); Seon-Il Yu, Gwangmyeong (KR); Seon-Kyu Kim, Seoul (KR); Kun-Jun Seok, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/704,203

(22) Filed: Feb. 9, 2007

(65) Prior Publication Data

US 2007/0182295 A1 Aug. 9, 2007

Related U.S. Application Data

(62) Division of application No. 10/508,976, filed on Sep. 24, 2004, now Pat. No. 7,467,834.

(30) Foreign Application Priority Data

| | | |
|---|---|---|
| Apr. 3, 2002 | (KR) | 2002-0018332 |
| Oct. 10, 2002 | (KR) | 2002-0061886 |
| Oct. 10, 2002 | (KR) | 2002-0061887 |
| Nov. 25, 2002 | (KR) | 2002-0073671 |
| Nov. 25, 2002 | (KR) | 2002-0073672 |
| Nov. 26, 2002 | (KR) | 2002-0074088 |
| Mar. 4, 2003 | (WO) | PCT/KR03/00416 |

(51) Int. Cl.
*A47B 88/00* (2006.01)

(52) U.S. Cl. ..... 312/402; 312/325

(58) Field of Classification Search ..... 312/402, 312/405, 303, 276, 274, 296, 348.4, 323, 312/322, 273, 330.1, 401, 404, 325; 220/558; 292/251; 126/41 D, 340, 335; 16/49, 86 R, 16/375, 374, 319, 349, 239, 362, 363; 62/382
See application file for complete search history.

(56) References Cited

U.S. PATENT DOCUMENTS

| | | | | | |
|---|---|---|---|---|---|
| 472,523 | A | * | 4/1892 | Chain | 296/58 |
| 715,334 | A | | 12/1902 | Allen | |
| 1,702,518 | A | * | 2/1929 | Morley | 126/41 E |
| 1,865,212 | A | * | 6/1932 | Rogers et al. | 126/340 |
| 1,892,020 | A | * | 12/1932 | Straubel | 220/558 |
| 1,935,582 | A | * | 11/1933 | Straubel | 220/558 |
| 1,975,806 | A | * | 10/1934 | Straubel | 220/558 |
| 1,983,573 | A | * | 12/1934 | Straubel | 220/558 |
| 2,021,019 | A | * | 11/1935 | Pickup | 126/41 D |
| 2,090,648 | A | | 8/1937 | Straubel | |
| 2,116,370 | A | * | 5/1938 | Watkins | 109/70 |
| 2,381,598 | A | * | 8/1945 | Jones | 312/291 |
| 2,446,336 | A | | 8/1948 | Mark et al. | |

(Continued)

FOREIGN PATENT DOCUMENTS

| | | |
|---|---|---|
| JP | 56-012911 | 2/1981 |

(Continued)

*Primary Examiner*—James O Hansen
(74) *Attorney, Agent, or Firm*—KED & Associates, LLP

(57) ABSTRACT

A door apparatus for a drawer for a drawer type refrigerator where the drawer is slidably coupled to a main body of the refrigerator is provided. The door apparatus includes a door with a thermally isolating layer, and a frame that moves simultaneously with the door and which provides a storage space for accommodating stored goods. The door is rotatably coupled to a front end of the frame, thus allowing the door to rotate through a predetermined angle with respect to the frame. An amount of rotation of the door with respect to the frame may be selectively limited to utilize a tilting function of the door and to provide access to goods in the storage space.

8 Claims, 18 Drawing Sheets

U.S. PATENT DOCUMENTS

| | | | | | |
|---|---|---|---|---|---|
| 2,486,564 | A | * | 11/1949 | Kamin | 126/41 E |
| 2,507,217 | A | * | 5/1950 | Mounce | 312/274 |
| 2,541,453 | A | | 2/1951 | Lane | |
| 2,564,673 | A | * | 8/1951 | Chauvin | 312/184 |
| 2,584,480 | A | | 2/1952 | Manting | |
| 2,711,944 | A | | 6/1955 | Meek et al. | |
| 2,843,441 | A | | 7/1958 | Jewell | |
| 3,219,404 | A | | 11/1965 | Machingo et al. | |
| 3,232,654 | A | | 2/1966 | Israelson et al. | |
| 3,295,908 | A | | 1/1967 | Dawley et al. | |
| 3,312,492 | A | | 4/1967 | Kurt | |
| 3,575,483 | A | * | 4/1971 | Church et al. | 312/328 |
| 3,621,684 | A | | 11/1971 | Horvay et al. | |
| 3,647,165 | A | | 3/1972 | Whitla | |
| 3,888,525 | A | | 6/1975 | Kousens | |
| 4,149,518 | A | | 4/1979 | Schmidt et al. | |
| 4,495,674 | A | * | 1/1985 | Haddock, Jr. | 16/302 |
| 4,604,770 | A | * | 8/1986 | Lang | 16/363 |
| 4,790,146 | A | * | 12/1988 | Mun et al. | 62/441 |
| 4,980,800 | A | | 12/1990 | Furuta | |
| 6,474,120 | B1 | | 11/2002 | Wadsworth et al. | |
| 6,811,236 | B1 | | 11/2004 | Spong et al. | |
| 2006/0049731 | A1 | * | 3/2006 | Choi et al. | 312/330.1 |
| 2007/0126325 | A1 | * | 6/2007 | Gorz et al. | 312/404 |

FOREIGN PATENT DOCUMENTS

| | | |
|---|---|---|
| JP | 57-125992 | 8/1982 |
| JP | 9-84555 | 3/1997 |
| KR | 213143 B1 | 5/1999 |
| KR | 100213143 | 5/1999 |

* cited by examiner

DOOR APPARATUS FOR DRAWER TYPE REFRIGERATOR

This Application is a divisional of U.S. application Ser. No. 10/508,976 filed on Sep. 24, 2004 now U.S. Pat. No. 7,467, 834, the contents of which are hereby incorporated by reference.

TECHNICAL FIELD

The present invention relates to a drawer type refrigerator, and more particularly, to a door apparatus for a drawer for a drawer type refrigerator constructed to take out an inner storage unit by pulling forward a door of the door apparatus for the refrigerator.

BACKGROUND ART

Japanese Utility Model Laid-Open Publication (Sho)57-125992 discloses a structure capable of causing a door of a door apparatus for a drawer for a drawer type refrigerator to be tilted at a predetermined angle. However, in the door apparatus disclosed in the Japanese publication, the door is in close contact with a main body of the refrigerator by means of a magnetic force of a gasket in a state where the door is closed. Thus, there is a problem in that the close contact of the door with the main body of the refrigerator is deteriorated and cold air in the refrigerator leaks out.

Further, since the door is automatically pivoted even when tilting of the door is not required, there is a problem in that it is inconvenient to handle the door. If slits or guide pieces provided for guiding the tilting of the door are deformed by an external force, there is a problem in that the tilting operation of the door cannot be properly made.

Moreover, in the prior art, there is another problem in that the door returning to its original state from its tilted state strongly strikes a storage unit provided in the rear of the door and thus an impact is exerted on the storage unit.

SUMMARY OF INVENTION

The present invention is conceived to solve the aforementioned problems. An object of the present invention is to enhance close contact of a drawer door with a main body of a drawer type refrigerator.

Another object of the present invention is to allow a user to freely select and utilize a door tilting function of the door for the drawer type refrigerator.

A further object of the present invention is to allow a tilting operation of the door to be smoothly made.

A still further object of the present invention is to minimize an impact when the door returns to its original state from its tilted state.

According to one aspect of the present invention for achieving these objects, there is provided a door apparatus for a drawer for a drawer type refrigerator which can be put in and taken out from the interior of a main body of the refrigerator through guidance of rails, comprising a door with a thermally isolating layer; a frame disposed in the rear of the door to be simultaneously put in and taken out from the interior of the main body together with the door and provided with a storage space for accommodating stored goods; a rotating means for connecting the door to a front end of the frame and causing the door to rotate through a predetermined angle with respect to the frame; and a rotation limiting means for connecting the door to the frame and selectively limiting the rotation of the door.

According to another aspect of the present invention, there is provided a door apparatus for a drawer for a drawer type refrigerator which can be put in and taken out from the interior of a main body of the refrigerator through guidance of rails, comprising a door with a thermally isolating layer; a frame disposed in the rear of the door to be simultaneously put in and taken out from the interior of the main body together with the door and provided with a storage space for accommodating stored goods; a rotating means for connecting the door to a front end of the frame and causing the door to rotate through a predetermined angle with respect to the frame; and a connection link including a plurality of links for connecting the door to the front end of the frame.

According to a further aspect of the present invention, there is provided a door apparatus for a drawer for a drawer type refrigerator which can be put in and taken out from the interior of a main body of the refrigerator through guidance of rails, comprising a door with a thermally isolating layer; a frame disposed in the rear of the door to be simultaneously put in and taken out from the interior of the main body together with the door and provided with a storage space for accommodating stored goods; hinge units of which each includes a plurality of links and exerts an elastic force so as to connect the door to a front end of the frame and cause the door to rotate through a predetermined angle with respect to the frame; and a rotation limiting means for connecting the door to the frame and selectively limiting the rotation of the door.

According to a still further aspect of the present invention, there is provided a door apparatus for a drawer for a drawer type refrigerator which can be put in and taken out from the interior of a main body of the refrigerator through guidance of rails, comprising a door with a thermally isolating layer; a frame disposed in the rear of the door to be simultaneously put in and taken out from the interior of the main body together with the door and provided with a storage space for accommodating stored goods; a rotating means for connecting the door to a front end of the frame and causing the door to rotate through a predetermined angle with respect to the frame; and a shock-absorbing means provided between a rear face of the door and the front end of the frame for absorbing an impact generated when the door comes into close contact with the frame.

DETAILED DESCRIPTION OF THE PREFERRED EMBODIMENT

Hereinafter, preferred embodiments of a door apparatus for a drawer for a drawer type refrigerator will be described in detail with reference to the accompanying drawings.

Figure 1:
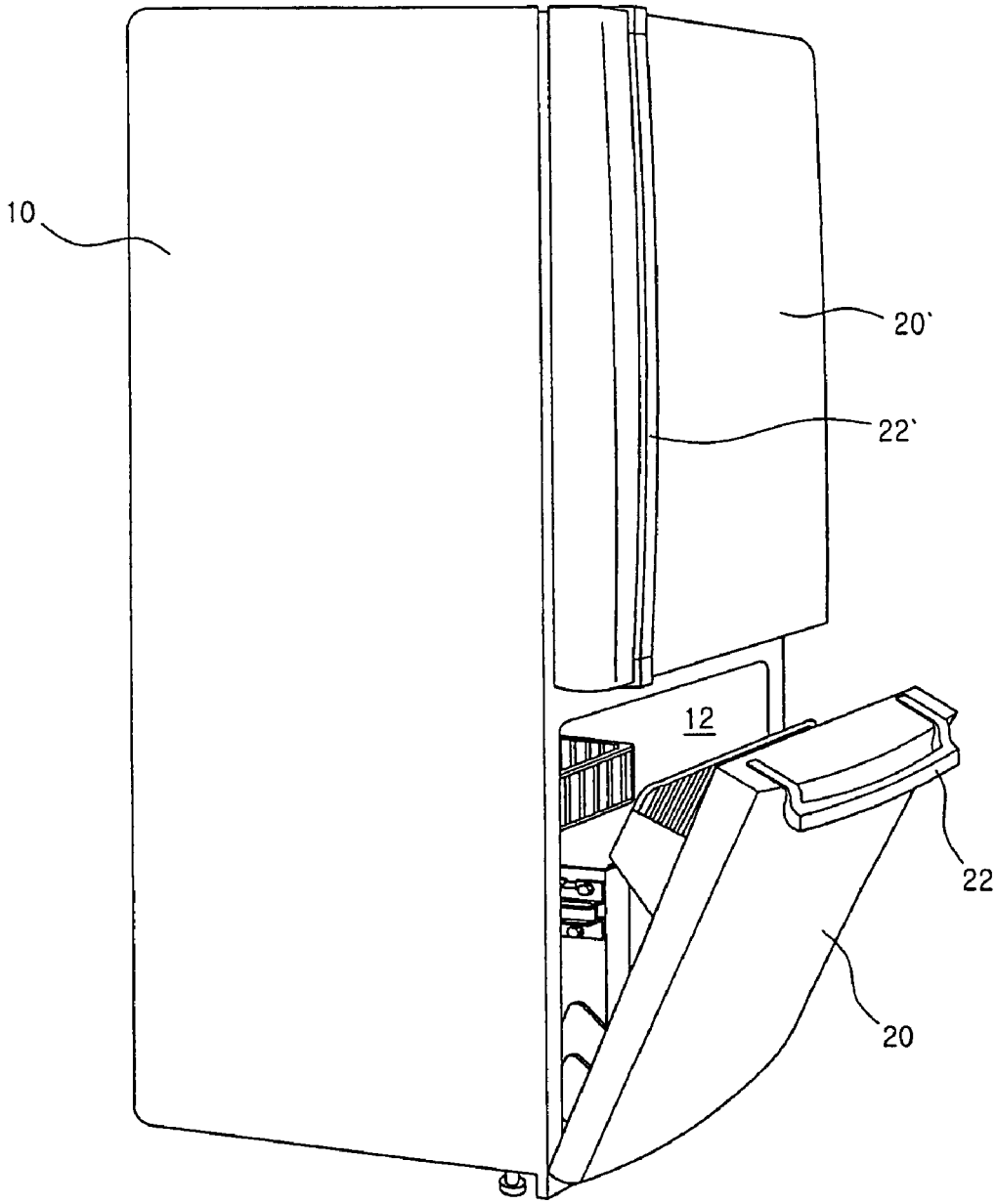
FIG. 1 is a perspective view of a refrigerator employing a preferred embodiment of a door apparatus for a drawer for a drawer type refrigerator according to the present invention.

As shown in FIG. 1, a main body 10 of the refrigerator has an isolated inner space 12 that is thermally isolated from the outside. Doors 20 and 20' are installed on a front face of the main body 10 so that the isolated inner space 12 can selectively communicate with the outside. In the illustrated embodiment, the door 20 is a drawer door provided at a lower portion of the main body 10, and the door 20' is constructed to be opened and closed while being horizontally pivoted on a hinge shaft provided at the right of the front face when a door handle 22' of the door 20' is pulled forward by a user.

The door 20 is provided with a door handle 22 at an upper end of a front face thereof. The door 20 is a drawer type door that is opened when the user pulls forward the door handle 22, and is particularly constructed to be tilted forward at a predetermined angle. Therefore, as shown in FIG. 1, the isolated inner space 12 can be opened by simply tilting the door 20 even without pulling forward the door 20.

Figure 2:
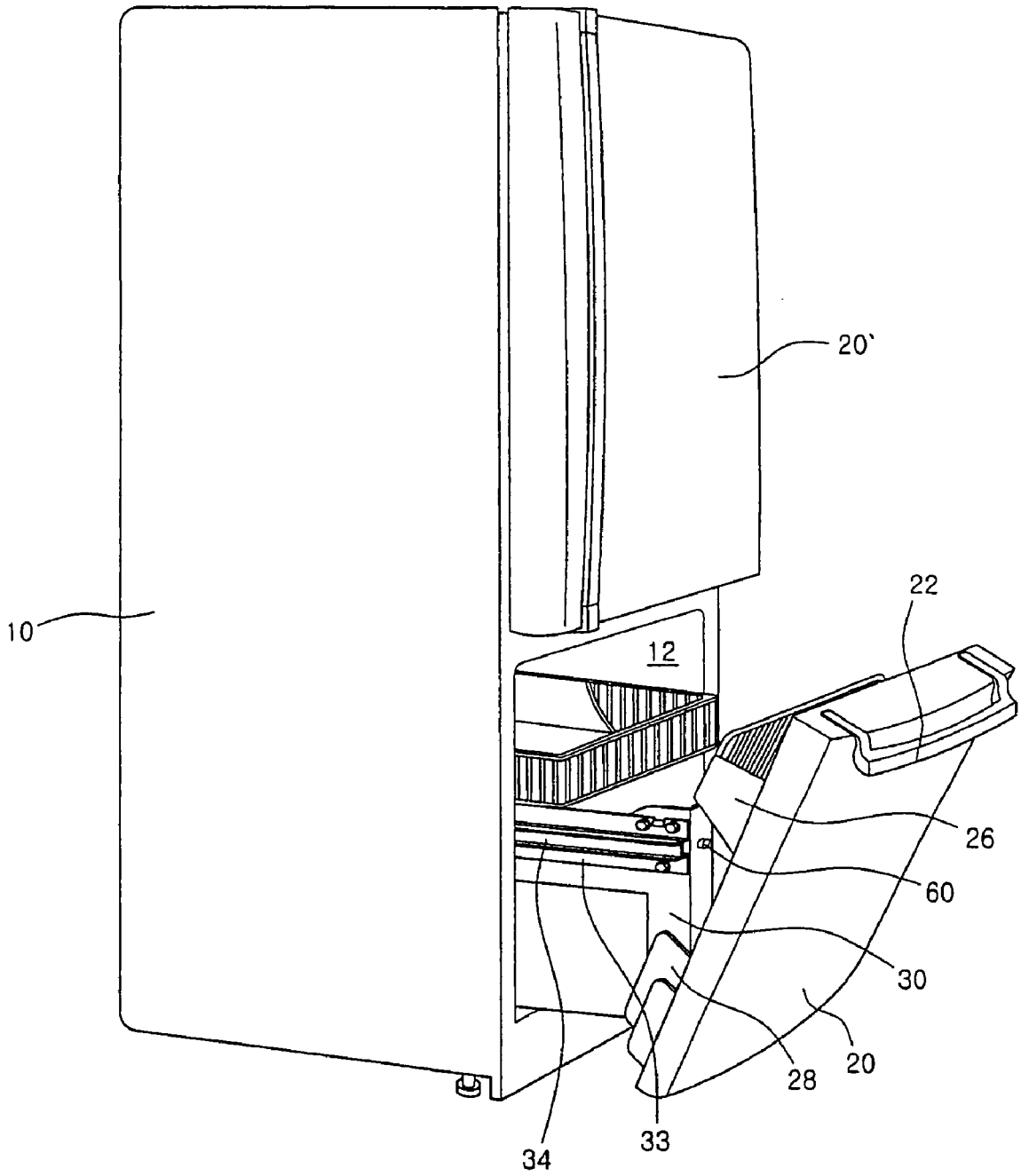
FIG. 2 is a perspective view of the refrigerator employing the embodiment of the present invention in a state where a door of the door apparatus is tilted and pulled out.

Further, as shown in FIG. 2, when the door 20 is pulled forward, the whole door is opened so that a space for use in taking in and out foodstuffs becomes larger than that of a conventional one. Thus, it is apparent that there is convenience of use. FIG. 2 shows a state where the door 20 is tilted at a predetermined angle.

Figure 3:
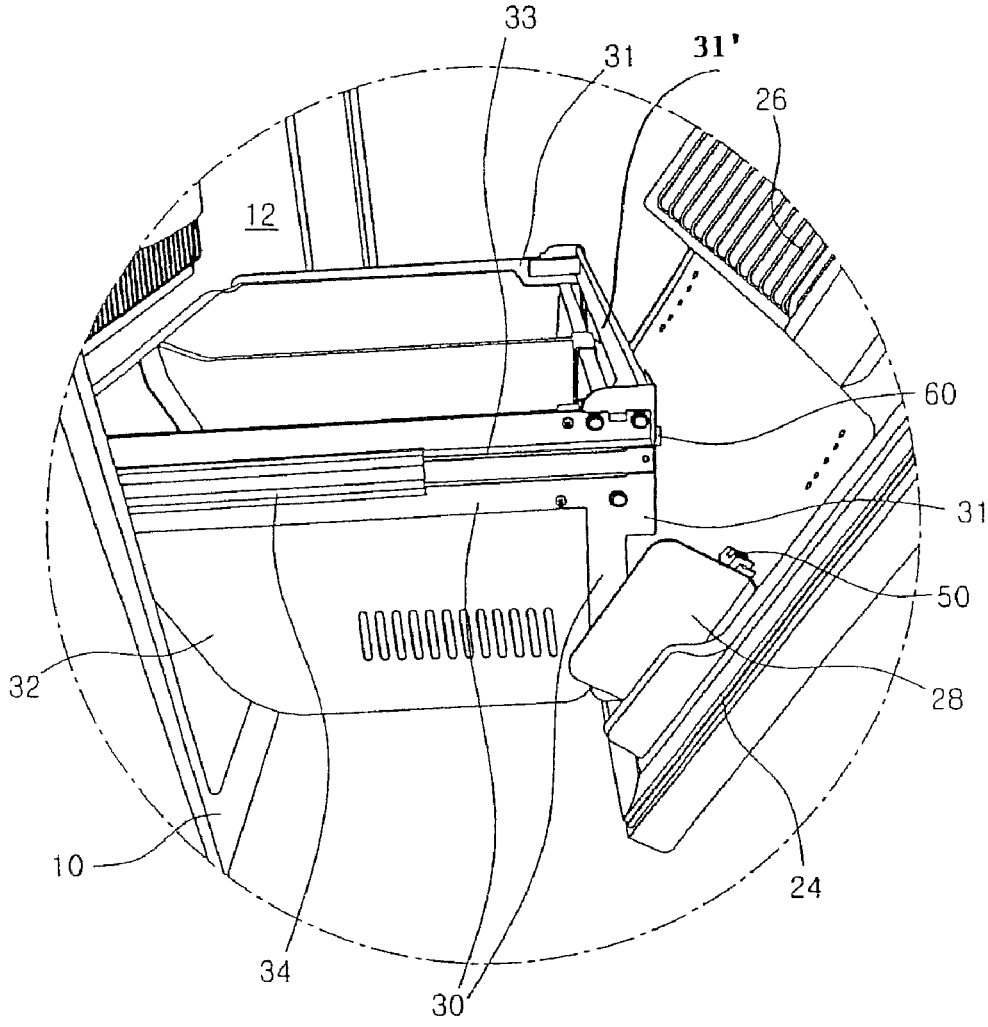
FIG. 3 is a perspective view showing the inner configuration of the refrigerator employing the embodiment of the present invention.

Next, a specific embodiment of the present invention will be described in detail with reference to FIGS. 3, 4*a* and 4*b*. A gasket 24 is provided along a marginal portion of a rear face of the door 20. The gasket 24 is in close contact with the front face of the main body 10 to prevent leakage of cold air when the door 20 is closed. Reference numeral 26 designates a door pocket.

Guide plates 28 are provided on both sides of a lower end of the rear face of the door 20. The guide plates 28 are installed to be spaced apart by a predetermined distance from both ends of a frame 30 to be described later and functions to shield hinge units 40 to be described later.

The support frame 30 is provided in the rear of the door 20. The support frame 30 is coupled at a lower end thereof to the door 20 through the hinge units 40. A basket 32 is supported within the frame 30. Therefore, the basket 32 is put in or taken out from the main body 10 together with the door 20. The frame 30 may have any configurations so far as it can support the basket 32. In this embodiment, the frame 30 comprises both side plates 31 and a connection bar 31' for connecting the side plates 31. The connection bar 31' connects upper portions of front ends of the side plates 31 to each other. The side plates 31 are formed to extend rearward and downward from upper portions of a front end of the frame 30.

Fixing rails 33 are provided on the side plates 31 of the frame 30. The fixing rails 33 are provided with movable rails 34 to be guided by guide rails (not shown) provided on both sidewalls of the isolated inner space of the main body 10, so that the door 20 can be opened and closed.

Locking portions 36 are formed at the front end of the frame 30 to face the rear face of the door 20. Each of the locking portions 36 is formed by cutting and bending a portion of the relevant side plate 31 of the frame 30. The locking portions 36 have a predetermined length extending toward the rear face of the door 20.

Next, the hinge units 40 for connecting the frame 30 to the door 20 will be explained with reference to FIG. 4. In this embodiment, each of the hinge units 40 comprises a plurality of links. That is, each of the hinge units 40 is constructed such that a door hinge portion 41 mounted on the rear face of the door 20 and a frame hinge portion 41' mounted on the frame 30 are connected through first and second connection links 42 and 43 to the door so as to open and close the door 20.

One end of the first connection link 42 is installed on the door hinge portion 41 to be pivoted on a connection pin 42*p*, and the other end thereof is installed to penetrate through the frame hinge portion 41'. The frame hinge portion 41' is constructed to have a "⊏-shaped" cross-section through which the fist connection link 42 penetrates.

A spring 47 provided in the door hinge portion 41 is connected to the end of the first connection link 42. The spring 47 provides the first connection link 42 with an elastic force so that the door 20 can vertically stand. A catching hook 42*h* is formed at the other end of the first connection link 42 to be caught by a stopper 45 provided in the frame hinge portion 41' when the door 20 is fully tilted. The stopper 45 is installed such that both ends thereof are supported within the frame hinge portion 41'.

One end of the second connection link 43 is installed on the door hinge portion 41 to be pivoted on a connection pin 43*p*. The other end of the second connection link 43 is installed to penetrate through the frame hinge portion 41' in the same manner as the first connection link 42. The other end of the second connection link 43 is formed with a catching surface 43*f* to be selectively caught by a catching pin 46 provided on the frame hinge portion 41'.

Figure 4A:
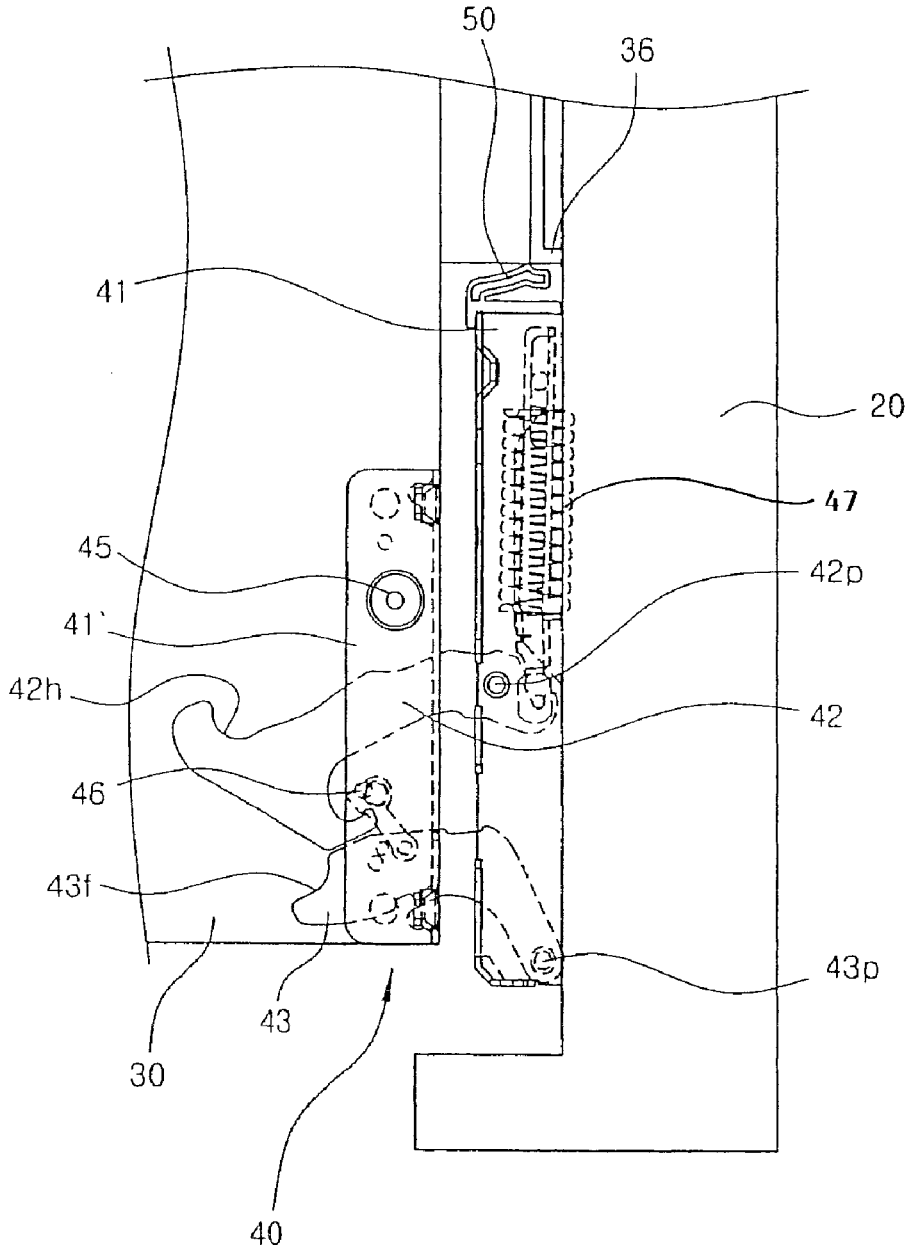
FIGS. 4*a* and 4*b* are the configuration and operation of a hinge unit constituting the embodiment of the present invention.
Figure 4B:
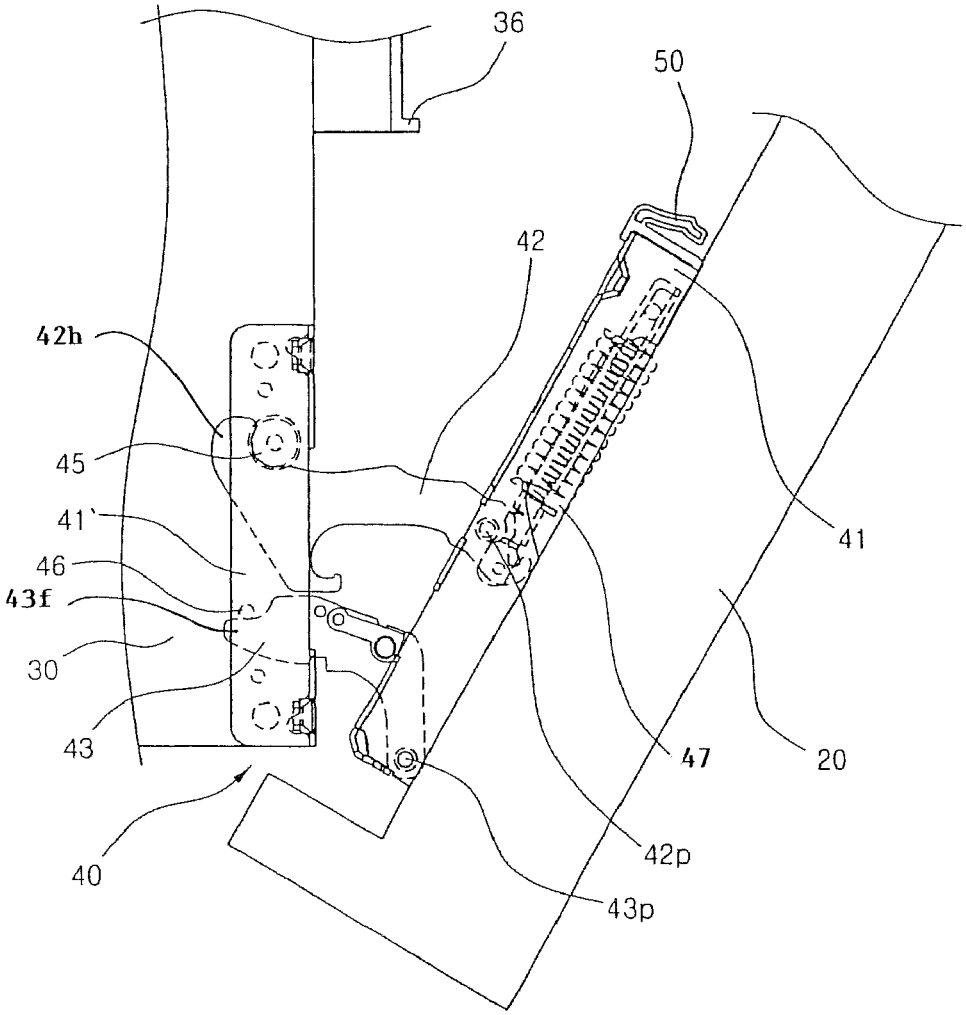

FIG. 4*a* shows the first and second connection links 42 and 43 in a state where the door is not tilted, and FIG. 4*b* shows them in a state where the door is fully tilted. In the fully tilted state, the catching hook 42*h* of the first connection link 42 is caught by the stopper 45 and the catching surface 43*f* of the second connection link 43 is caught by the catching pin 46.

Tilting locks 50 are provided on portions of the rear face of the door 20 corresponding to the locking portions 36 of the frame 30. The configuration of the tilting locks 50 is well shown in FIGS. 5*a* to 5*c*. Each of the tilting locks 50 is formed through molding and comprises a base plate 52 fastened to the door hinge portion 41. The base plate 52 is fastened to an upper end of the door hinge portion 41 by means of a fastening screw 50'. A resilient piece 54 is provided in the based plate 52 to extend from one side thereof. The resilient piece 54 is constructed to be elastically deformed in view of its shape and material and to extend from one end of the base plate 52 toward the other end thereof.

One end of the resilient piece 54 is connected to the base plate 52 and the remainder thereof is formed to be spaced apart by a predetermined distance from a top surface of the base plate 52. A top surface of the resilient piece 54 is formed with a leading guide surface 55 and a trailing guide surface 56. A portion where the leading and trailing guide surfaces 55 and 56 meet each other is formed to have the highest height in order to form a locking step 57. Here, a portion of the locking step 57 on the side of the leading guide surface 55 is slanted to catch the locking portion 36, and a portion of the locking step 57 on the trailing guide surface 56 is slanted so that the locking portion 36 can smoothly slide thereon. The locking step 57 functions to prevent the door 20 from being tilted in such a manner that the portion of the locking step 57 on the side of the leading guide surface 56 is caught by the locking portion 36.

Meanwhile, the user can insert a spacer 58 between the base plate 52 and the resilient piece 54 of the tilting lock 50 to prevent the door 20 from being tilted. The spacer 58 prevents the resilient piece 54 from being elastically deformed and thus prevents the tilting of the door 20. Such a spacer 58 is separately formed and stored in the door pocket 26 or the like so that the user can utilize it if necessary.

A shock-absorbing member 60 is installed on a front face of the frame 30, i.e. a face of the frame facing the rear face of the door 20. The shock-absorbing member 60 functions to absorb an impact exerted on the frame 30 when the door 20 has been tilted and returns to its original state. The shock-absorbing member 60 may be installed on the rear face of the door 20.

The operation of the preferred embodiment of the present invention constructed as above will be described.

Figure 5A:
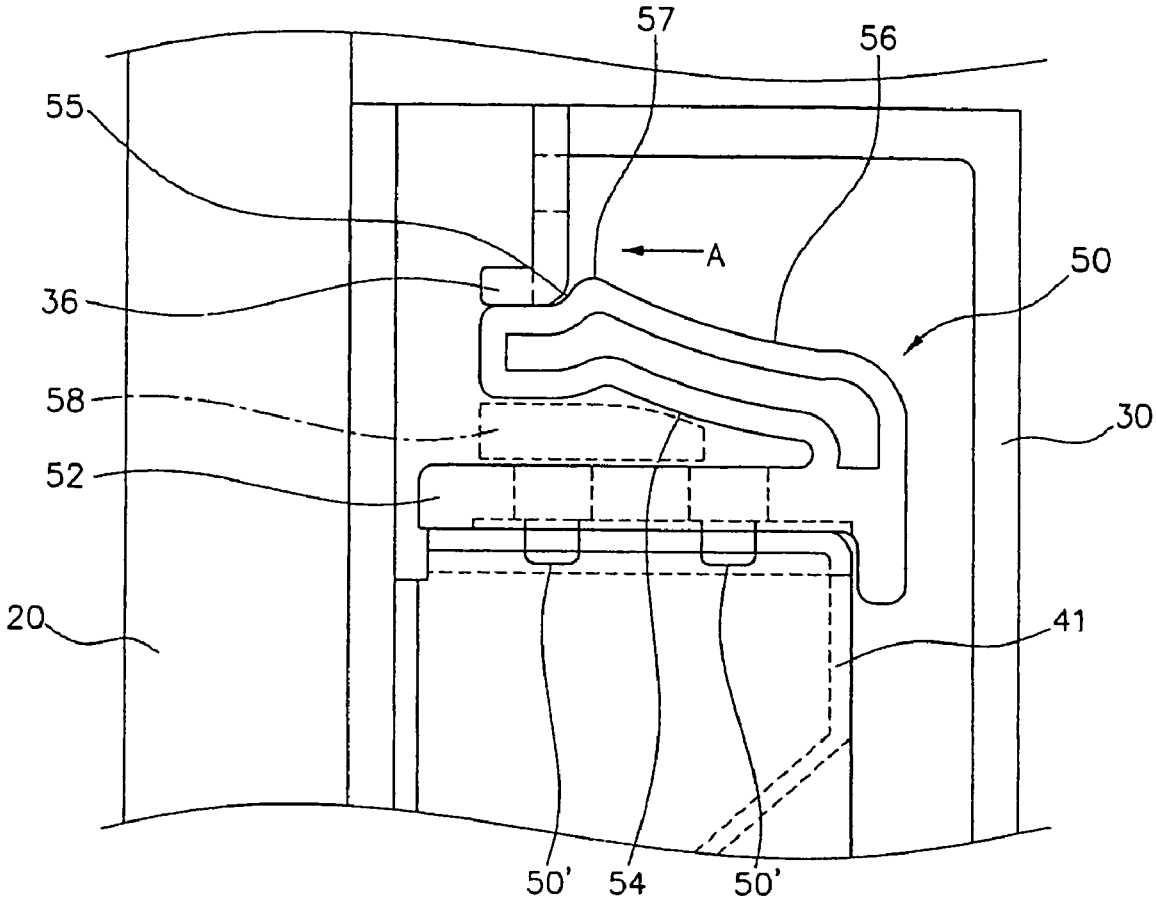
FIGS. 5*a* to 5*c* are operational views sequentially showing the relationship between a tilting lock and a locking portion in the embodiment of the present invention.

In this embodiment, the user can select whether the door 20 is used to be tilted. That is, in a state where the door 20 stands vertically, the tilting lock 50 is caught by the locking portion 30 of the frame 30 as shown in FIG. 5*a*. The locking portion 36 sits on the leading guide surface 55 formed in the resilient piece 54 of the tilting lock 50 so as to maintain a state where the locking portion is caught by the locking step 57. Therefore, when the user pulls the door 20, the tilting lock 50 provided in the door hinge portion 41 tends to move in a direction designated by an arrow A in the figure. However, the locking step 57 is caught and thus cannot pass by the locking portion 36.

In this state, the door 20 and the frame 30 are united with each other through the coupling of the locking portion 36 and the tilting lock 50. Therefore, the door 20 is not tilted with respect to the frame 30 and pulled together with the frame 30 so that they are pulled out of the main body 10.

On the other hand, in order to tilt the door 20, the door 20 should be pulled simply with a relatively large force. That is, the door 20 is pulled with such a force that the resilient piece 54 of the tilting lock 50 is caused to be elastically deformed by means of the locking portion 36.

Figure 5B:
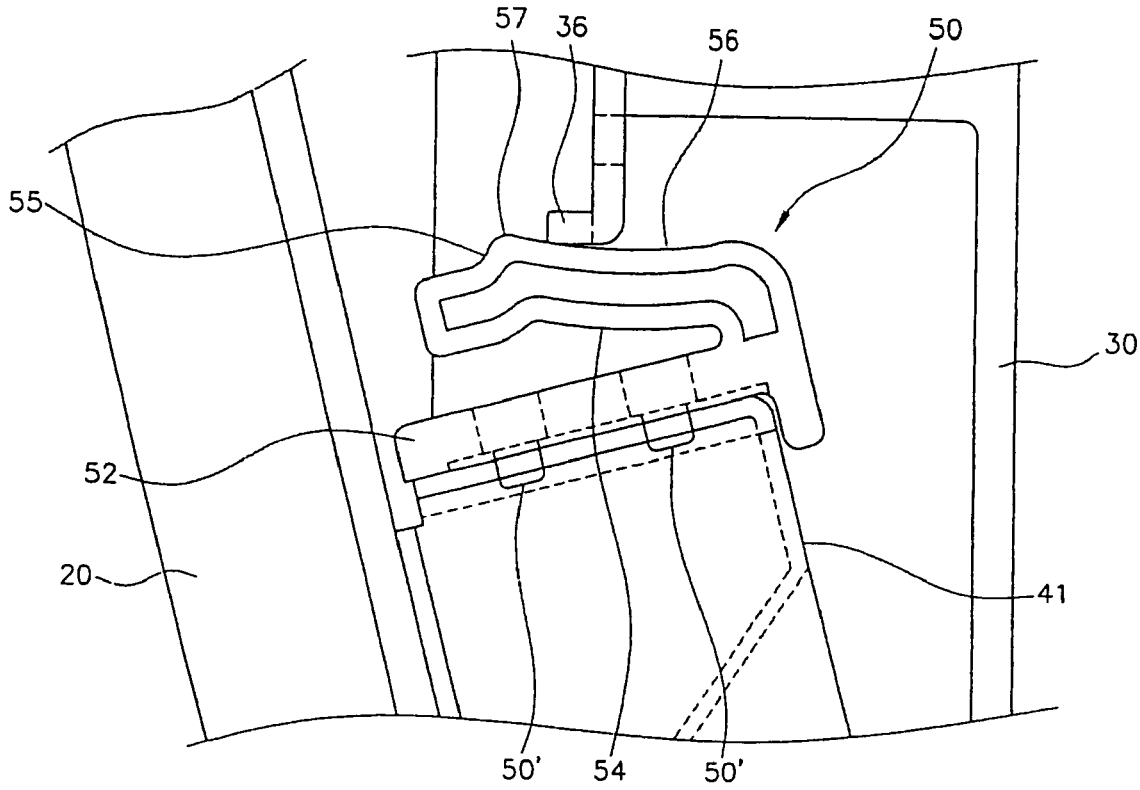
Figure 5C:
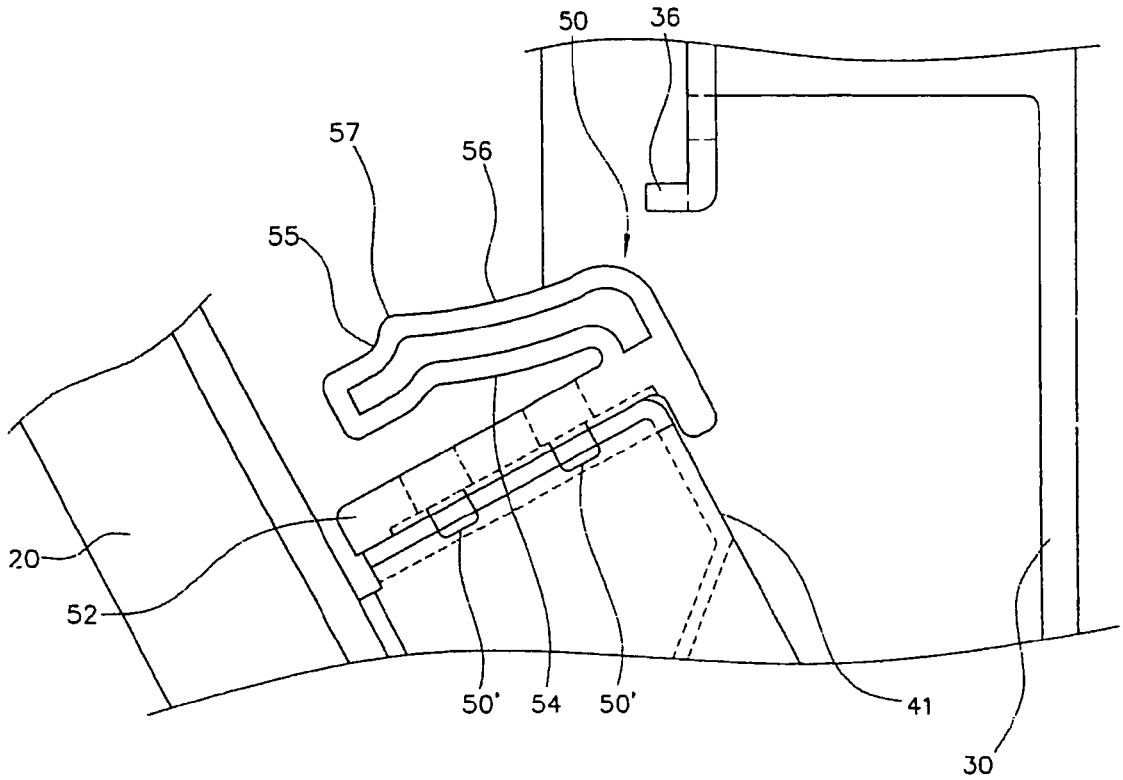

In this state, the resilient piece 54 instantaneously becomes closer to the base plate 52 by means of the locking portion 36 so that the locking step 57 is released from the state where it is caught by the locking portion 36. FIG. 5*b* shows a state where the resilient piece 54 passes by the locking portion 36, and FIG. 5*c* shows the relationship between the tilting lock 50 and the locking portion 36 when the door 20 is tilted.

Then, if the force pulling the door 20 is removed, the door 20 returns to its original state by means of a restoring force of the spring 47 of the hinge unit 40. When the door 20 returns to its original state, the trailing guide surface 56 of the tilting lock 50 is guided along the locking portion 36. Further, as the locking step 57 passes by the locking portion 36, the resilient piece 54 is elastically deformed so that the door 20 can be completely closed. When the locking step 57 has passed by the locking portion 36, the state shown in FIG. 5*a* is established.

In the meantime, in order to prevent the door 20 from being tilted regardless of a user's force pulling the door 20, the spacer 58 is inserted into the tilting lock 50. If the spacer 58 is inserted between the base plate 52 and the resilient piece 54 of the tilting lock 50 as shown in a dotted line in FIG. 5*a*, the resilient piece 54 is prevented from being elastically deformed and thus the tilting of the door 20 is avoided.

Further, when the door 20 has been tilted and returns to its original state, the impact exerted on the frame 30 by the door 20 is absorbed by the shock-absorbing member 60. Thus, even though the door 20 is strongly closed, the whole impact is not transmitted to the frame 30.

Figure 6:
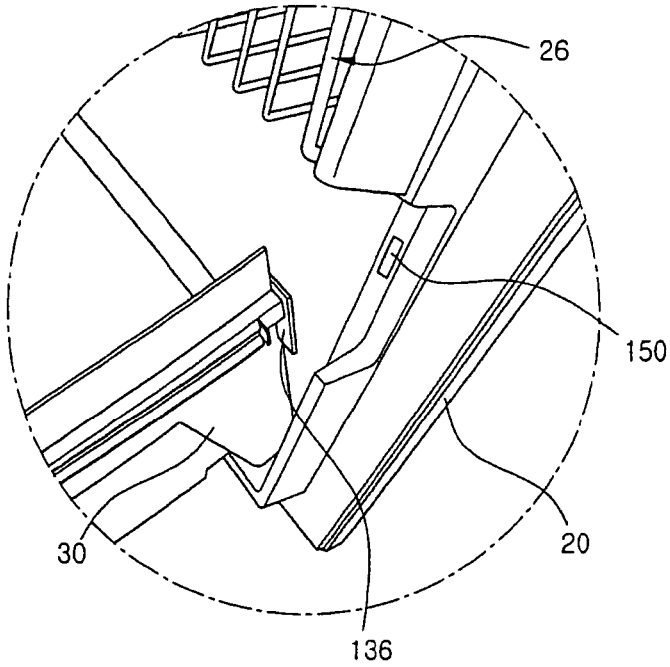
FIG. 6 is a side view showing the configuration of another embodiment of the present invention.

Next, another embodiment of the present invention will be described with reference to FIG. 6. In this embodiment, one side of the frame 30 that is connected to the rear face of the door 20, i.e. the front face of the frame 30 facing the rear face of the door 20, is formed with a close contact plate 136. It is preferred that close contact plates 136 be provided on both sides of the front face of the frame 30.

The close contact plates 136 are formed to vertically stand and are portions with which the rear face of the door 20 comes into close contact when the door 20 is closed. Further, the frame 30 is made of a magnetic material and, for example, the close contact plates 136 may be formed of the same material as the frame 30 made of a sheet metal and also formed integrally with the frame 30.

Electromagnets 150 are installed at portions on the rear face of the door 20 which come into close contact with the close contact plates 136. The electromagnets 150 themselves are constructed in the same manner as well-known electromagnets so that magnetic forces are generated upon supply of an electric current thereto. When the electric current is supplied to the electromagnets 150, the magnetic forces are generated. The magnetic forces strongly attract the close contact plates 136 that are in close contact with the electromagnets 150 when the door 20 is closed.

Therefore, since the close contact plates 136 are in strong and close contact with the electromagnets 150 upon supply of the electric current to the electromagnets 150, the door 20 is substantially prevented from being tilted. If the handle 22 is pulled forward in such a state, the door 20 is slidably pulled out together with the support frame 30.

A switch or control button 29 (see FIG. 7) for controlling the electric current supplied to the electromagnets 150 can be installed on the handle 22. Therefore, when the control button 29 is pressed, the supply of the electric current to the electromagnets 150 is shut off so that the door 20 can be in a tiltable state. Further, since there is no operation of the control button 29 in a state where the door 20 is closed, the electric current is supplied to the electromagnets 150. Thus, the door 20 can be in a locked state in which the door cannot be tilted.

In this embodiment, if the user presses the control button 29 installed on the handle 22 while opening the door 20, the door 20 is in the tiltable state. If the handle 22 is pulled in such a state, the door 20 is tilted. If the user pulls the handle 22 without pressing the control button 29, the door 20 can be simply pulled out forward without the tilting thereof.

Figure 7:
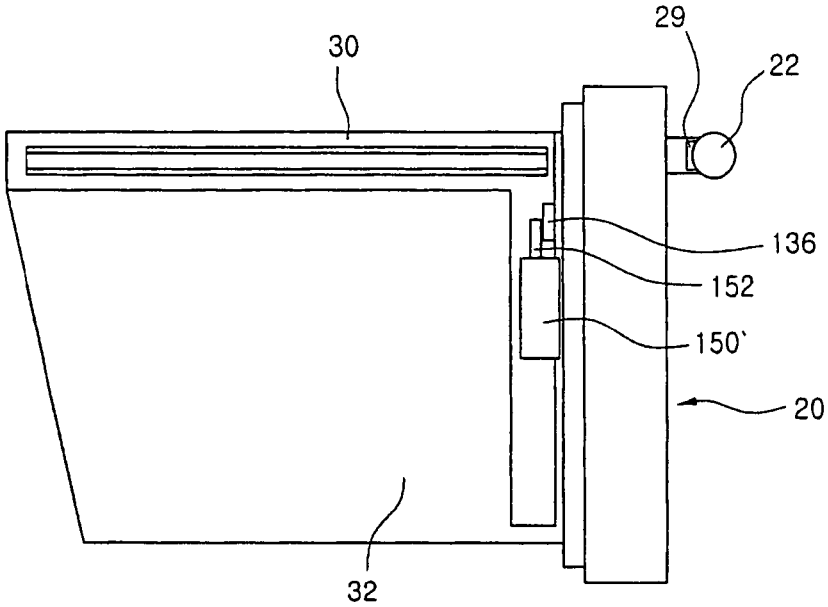
FIG. 7 is a side view showing the configuration of a further embodiment of the present invention.

Next, a further embodiment of the present invention is shown in FIG. 7. In this embodiment, solenoids 150' are installed on the rear face of the door 20. Each of the solenoids 150' has a plunger 152 that moves upward and downward according to whether an electric current is supplied thereto. For example, the plunger 152 is maintained in an upward protruding state if the electric current is supplied to the solenoid 150', whereas the plunger 152 moves downward if the supply of the electric current is shut off.

The plunger 152 of the solenoid 150' is disposed at a position corresponding to that of a rear surface of the relevant close contact plate 136 of the frame 30. Further, the plunger 152 moves upward and downward so that whether the door 20 will be tilted can be determined depending on the supply of the electric current to the solenoid 150'.

For example, if the plunger 152 moves upward in a state where the door 20 is closed, the plunger 152 is placed on the rear surface of the close contact plate 136 so that the door 20 cannot be tilted. When the user presses the control button 29 provided on the handle 20, the plunger 152 moves downward not to engage the close contact plate 136 so that the door 20 can be in the tiltable sate.

Figure 8:
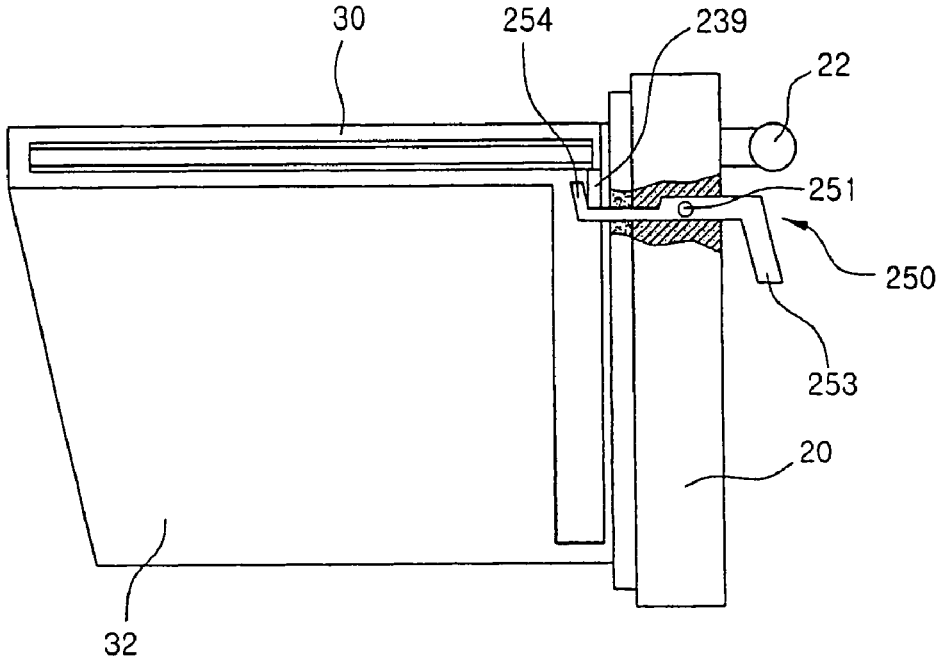
FIG. 8 is a partially cut-away side view showing the configuration of a still further embodiment of the present invention.

FIG. 8 shows a still further embodiment of the present invention. This embodiment employs a mechanism for determining whether the door 20 can be tilted. That is, a close contact piece 239 is provided at a front end of the frame 20, and an operating lever 250 is installed to penetrate through the door 20 in a fore and aft direction so that it can be selectively caught by the close contact piece 239.

The operating lever 250 is installed such that both ends thereof are pivotable on a hinge shaft 251 within the door 20. One end of the operating lever 250 protrudes beyond the front face of the door 20 to form an operating portion 253. The operating portion 253 slantingly extends forward and downward of the door 20. The other end of the operating lever 250 protrudes beyond the rear face of the door 20 to form a catching portion 254. It is preferred that the catching portion 254 extend nearly vertically in a direction opposite to the extending direction of the operating portion 253.

The operating lever 250 is installed to pivot on the hinge shaft 251 in a specific direction by means of an elastic member (not shown). In this embodiment, it is preferred that the catching portion 254 of the operating lever 250 be supported by the elastic member to pivot in a direction in which the catching portion is caught by a rear surface of the close contact piece 239.

Therefore, the catching portion 254 is normally maintained in a state where it is caught by the rear surface of the close contact piece 239. If the user grasps the operating portion 253 of the operating lever 250 and causes it to pivot upward, the catching portion 254 pivots downward on the hinge shaft 251 and thus is disengaged from the close contact piece 239.

At this time, it is preferred that the operating portion 253 of the operating lever 250 be installed at a position substantially close to the handle 22 of the door 20, for example, at a position slightly below the handle so that the user can simultaneously grasp the operating portion when he/she grasps the handle 22.

Figure 9:
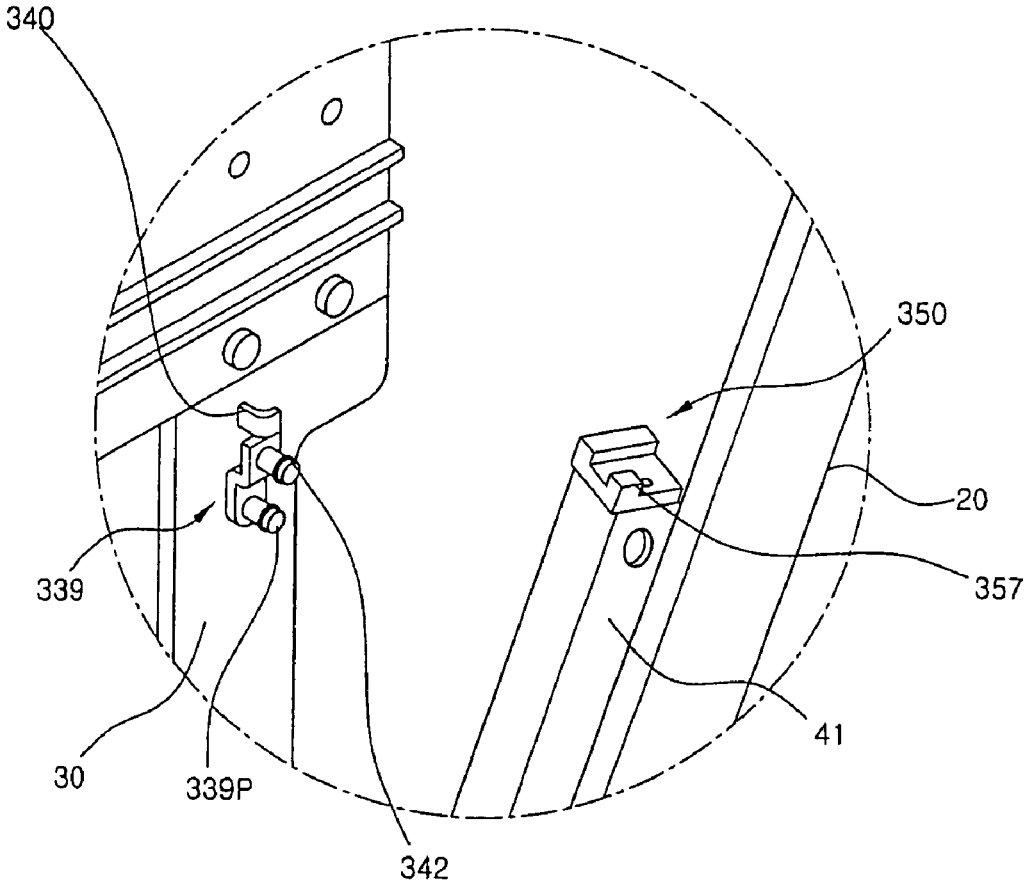
FIG. 9 is a perspective view showing the configuration of a still further embodiment of the present invention.

FIG. 9 shows a still further embodiment. of the present invention. In this embodiment, a locking lever 339 is installed at one side of the frame 30. The locking lever 339 is constructed such that a leading free end thereof can rotate about a rotation shaft 339*p* that is installed to penetrate through one side end of the frame 30. The free end of the locking lever 339 is provided with a catching hook 340 formed through bending. A knob 342 is provided at a portion of the locking lever 339 corresponding to between the catching hook 340 and the rotation shaft 339*p*. Although the knob 342 takes the shape of a rod in this embodiment, any types of knobs may be used so far as the user can operate the locking lever 339 with his/her hand.

A tilting lock 350 is provided on the door 20. The tilting lock 350 is provided at an upper end of the door hinge unit 41. A locking step 357 by which the catching hook 340 is caught is formed at one side of the tilting lock 350. The locking step 357 is formed to protrude from one side of a top surface of the tilting lock 350.

Figure 10:
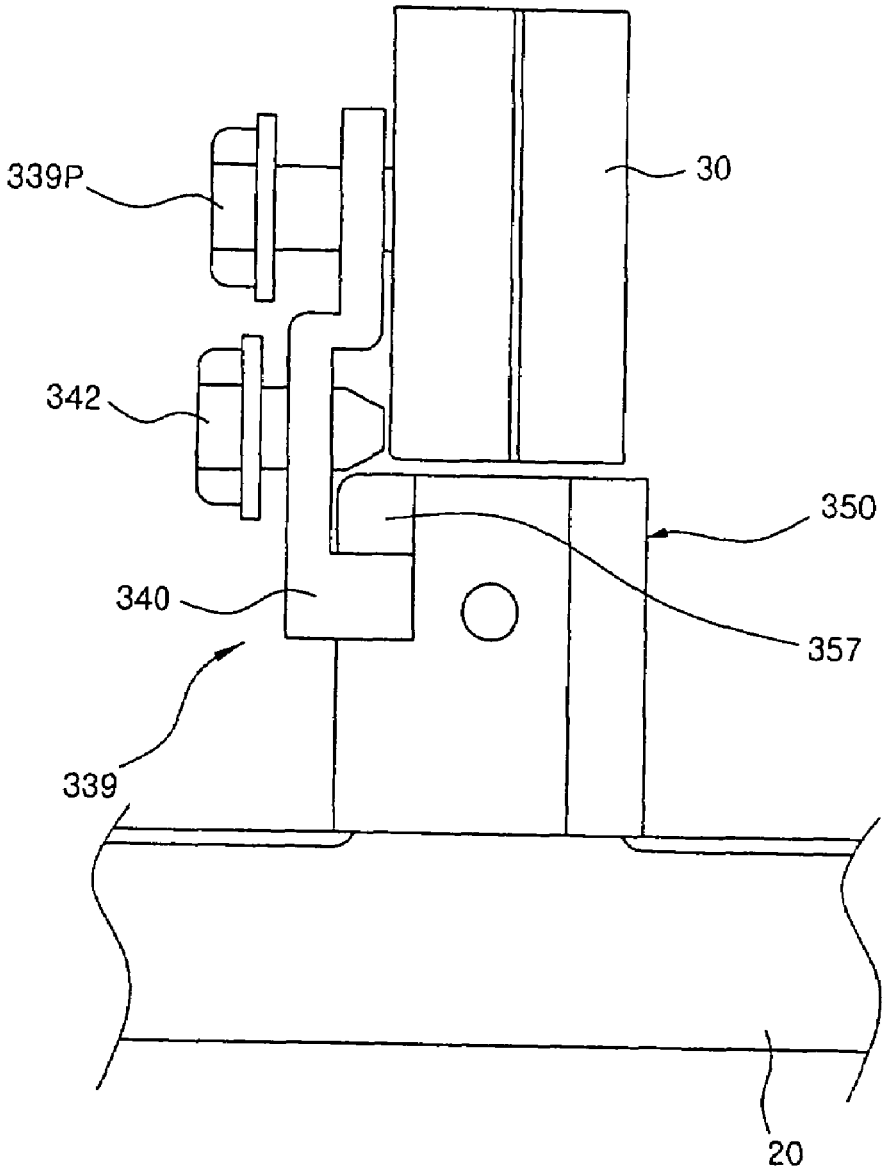
FIG. 10 is a view showing a use state where a door and a frame are coupled to each other in the embodiment shown in FIG. 9.

In this embodiment, the catching hook 340 of the locking lever 339 is caught by the locking step 357 so that the door 20 and the frame 30 are fastened to each other, as shown in FIG. 10. That is, in a state where the rear face of the door 20 is in close contact with the front face of the frame 30, the user grasps the knob 342 of the locking lever 339 of which the catching hook 340 is raised upward as shown in FIG. 9 and rotates the locking lever about the rotation shaft 339*p* so that the catching hook 340 is caught by the locking step 357.

In a state where the catching hook 340 of the locking lever 339 is caught by the locking step of the tilting lock 350, the door 20 cannot be tilted by the user and can be put in or taken out from the main body 10 together with the frame 30 that is united with the door 20.

Figure 11:
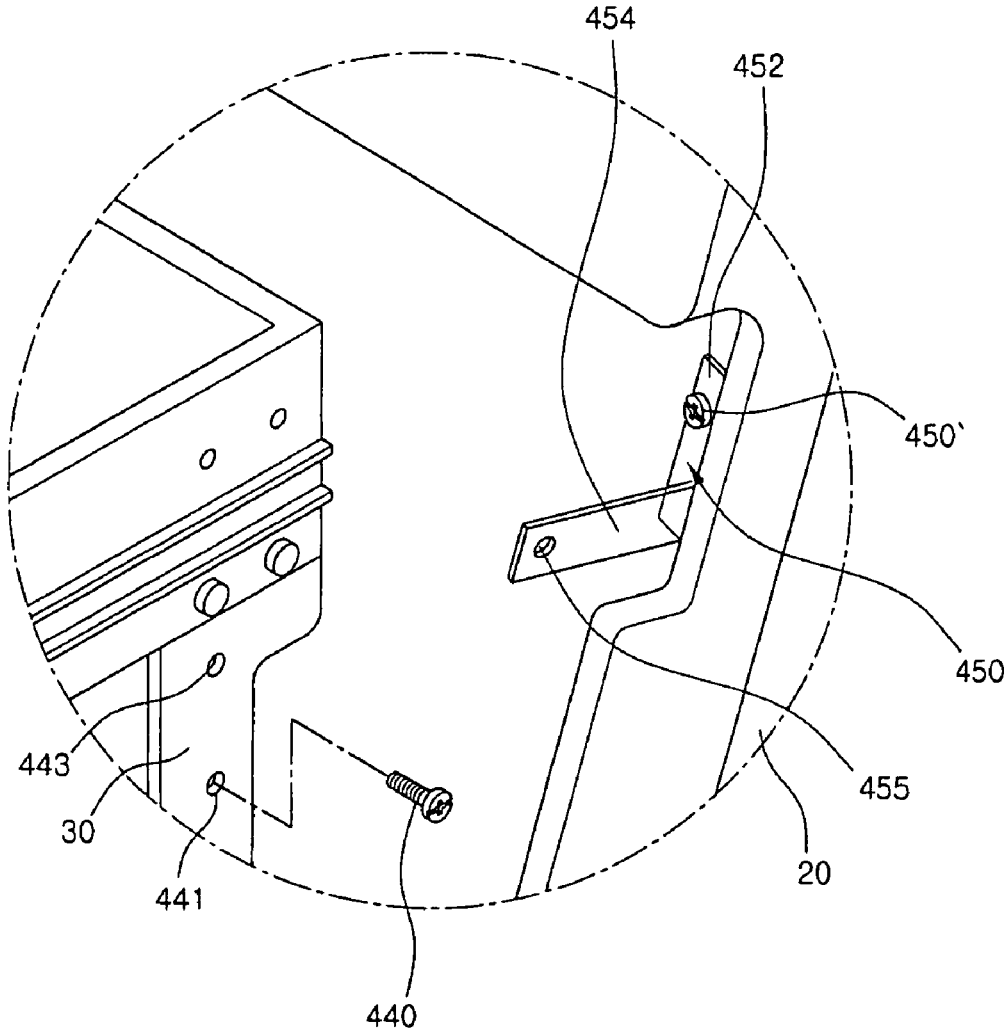
FIG. 11 is a perspective view showing the configuration of a still further embodiment of the present invention.

A still further embodiment of the present invention is shown in FIG. 11. In this embodiment, a locking screw 440 is used for allowing the user to select the tilting of the door 20. The locking screw 440 is stored in a storage hole 441 formed at a portion of a side plate 31 of the frame 30 in a normal condition, i.e. when the tilting of the door 20 is required.

A locking hole 443 is formed at another portion of the side plate 31. A fastening piece 454 of a tilting lock 450 to be described later is fastened to the locking hole 443 by means of the locking screw 440. The tilting of the door 20 is prevented in such a way.

The tilting lock 450 is installed on the door 20. The tilting lock 450 comprises the fastening piece 454 and a mounting piece 452. The fastening piece 454 functions to fasten the door 20 to the frame 30, whereas the mounting piece 452 functions to mount the tilting lock 450 to the door 20. The mounting piece 452 is mounted on the rear face of the door 20 by means of a mounting screw 450'.

In this embodiment, the fastening piece 454 is formed to be perpendicular to one side of the mounting piece 452 and to extend rearward of the door 20. A locking hole 455 is formed at a leading end portion of the fastening piece 454 so that it corresponds to the locking hole 443 when the rear face of the door 20 comes into close contact with the front face of the frame 30.

Figure 12:
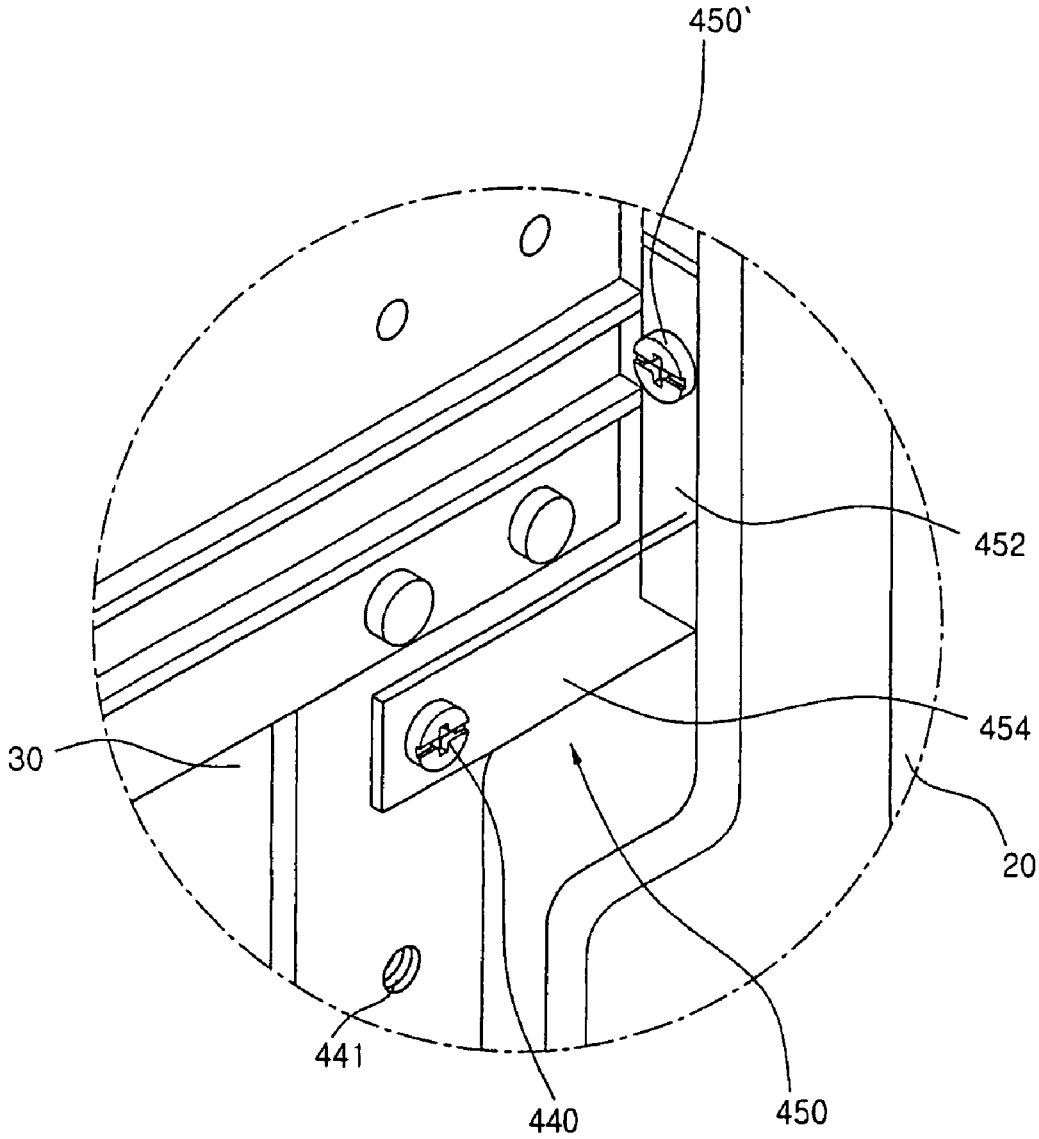
FIG. 12 is a view showing a use state where a door and a frame are coupled to each other in the embodiment shown in FIG. 11.

Meanwhile, FIG. 12 shows a state where the door 20 and the frame 30 are fastened to each other. That is, this state corresponds to a state where the user makes a selection so that the door 20 cannot be tilted. When the rear face of the door 20 is in close contact with the frame 30, the fastening piece 454 of the tilting lock 450 is positioned beside the side plate 31 of the frame 30. Further, the locking hole 455 of the fastening piece 454 corresponds to the locking hole 443 formed in the side plate 31.

In such a state, the locking screw 440 that has been fastened to the storage hole 441 in the normal state is unscrewed and then screwed into the locking hole 443 of the side plate 31 after penetrating through the locking hole 455 of the fastening piece 454. At this time, the door 20 and the frame 30 are fastened to each other to prevent the door 20 from being tilted.

Figure 13:
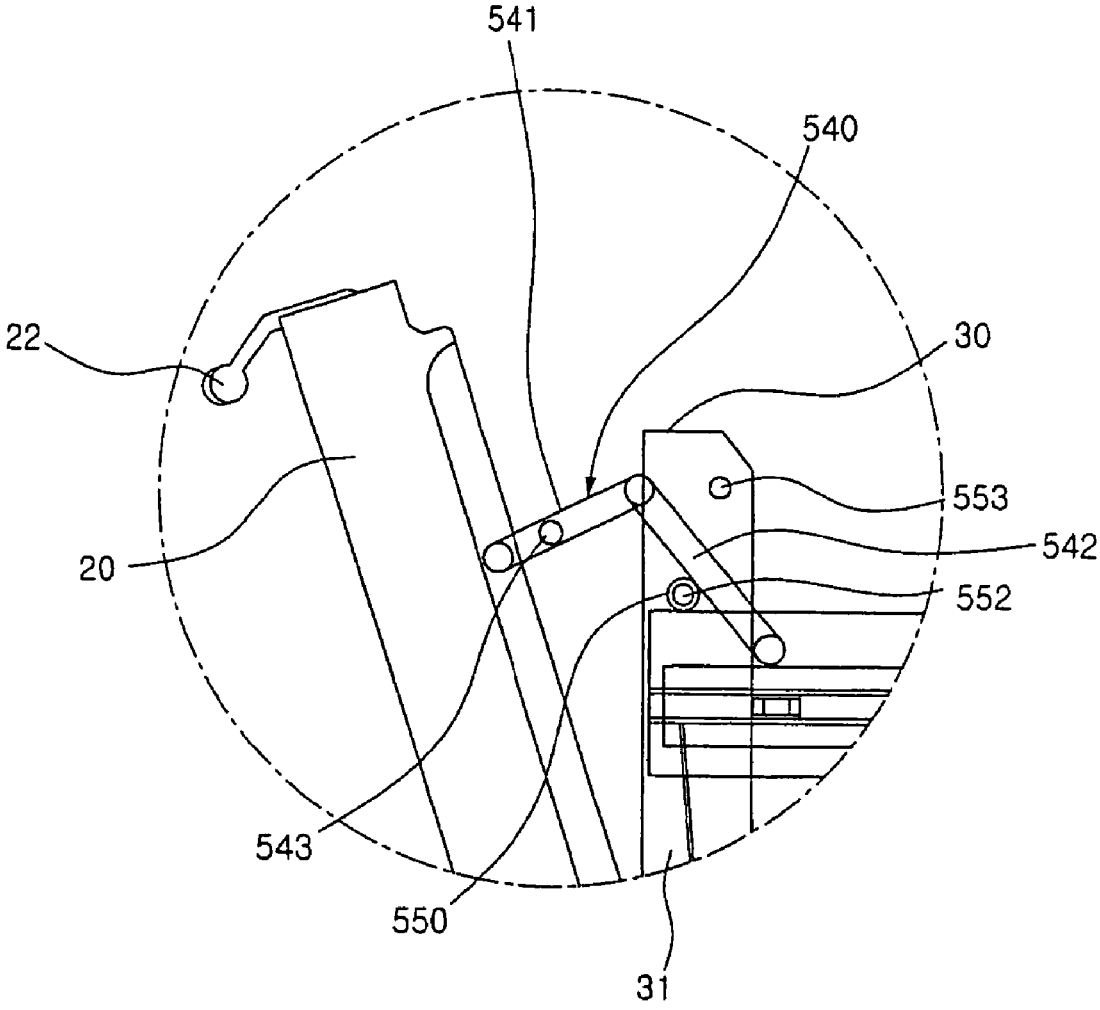
FIG. 13 is a partial side view showing the configuration of a still further embodiment of the present invention.
Figure 14:
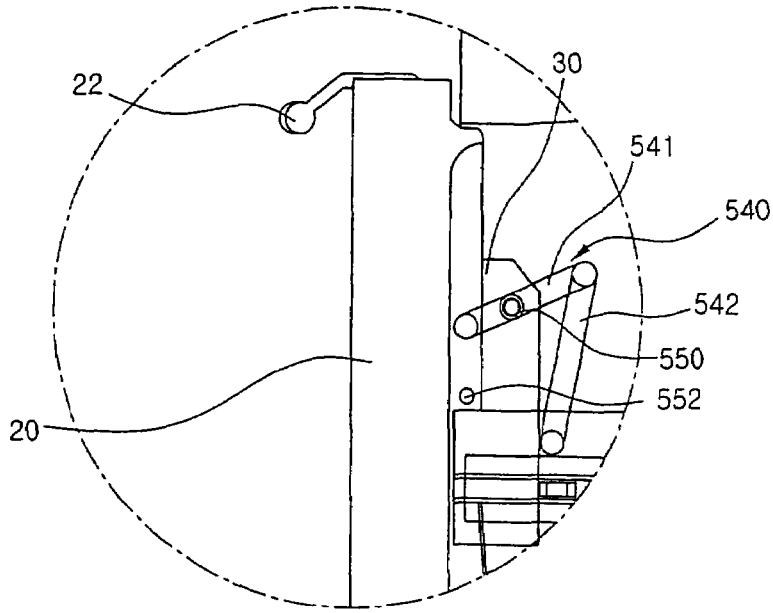
FIG. 14 is a view showing a use state where tilting of a door is prevented in the embodiment shown in FIG. 13.

FIGS. 13 and 14 show a still further embodiment of the present invention. As shown in these figures, a connection link 540 is provided to connect the rear face of the door 20 to the frame 30. The connection link 540 comprises a first link 541 and a second link 542 to be folded depending on the tilting of the door 20. It is preferred that connection links 540 be provided at both side ends of the door 20.

A portion of the first link 541 is perforated to form a locking hole 543. The locking hole 543 allows a fastener 550, which will be described later, to penetrate therethrough and to fix a connection link 540.

The fastener 550 is provided in the side plate 31 of the frame 30. A general screw can be used as the fastener 550. The fastener 550 is normally stored in a storage hole 552. The storage hole 552 is formed at a portion of the side plate 31 and has threads formed on an inner periphery thereof. Therefore, the fastener 550 can be fastened to and then stored in the storage hole 552.

Further, the side plate 31 is perforated to form a locking hole 553. The locking hole 553 is formed at a relatively upper end of the side plate 31. The locking hole 553 is formed at a position corresponding to that of the locking hole 543 of the first link 541 when the rear face of the door 20 comes into close contact with the frame 30.

In this embodiment constructed as above, the fastener 550 is placed in the storage hole 552 as shown in FIG. 13 if the user wants to utilize the tilting function of the door 20. In such a state, the door 20 can be tilted with respect to the frame 30. Of course, if the fastener 550 is on a moving path of the second link 542, the fastener 550 can regulate the degree of tilting of the door 20.

Meanwhile, if the user does not want to utilize the tilting of the door 20, the first link 541 is fastened to the frame 30 by using the fastener 550 as shown in FIG. 14. That is, the locking hole 543 of the first link 541 corresponds to the locking hole 553 of the frame 30 when the rear face of the door 20 is in close contact with the frame 30. In such a state, the fastener 550 is fastened to the locking hole 553 of the side plate 553 after penetrating through the locking hole 543. At this time, since the connection link 540 is fastened to the frame 30 not to be folded, the door 20 is prevented from being tilted.

Figure 15:
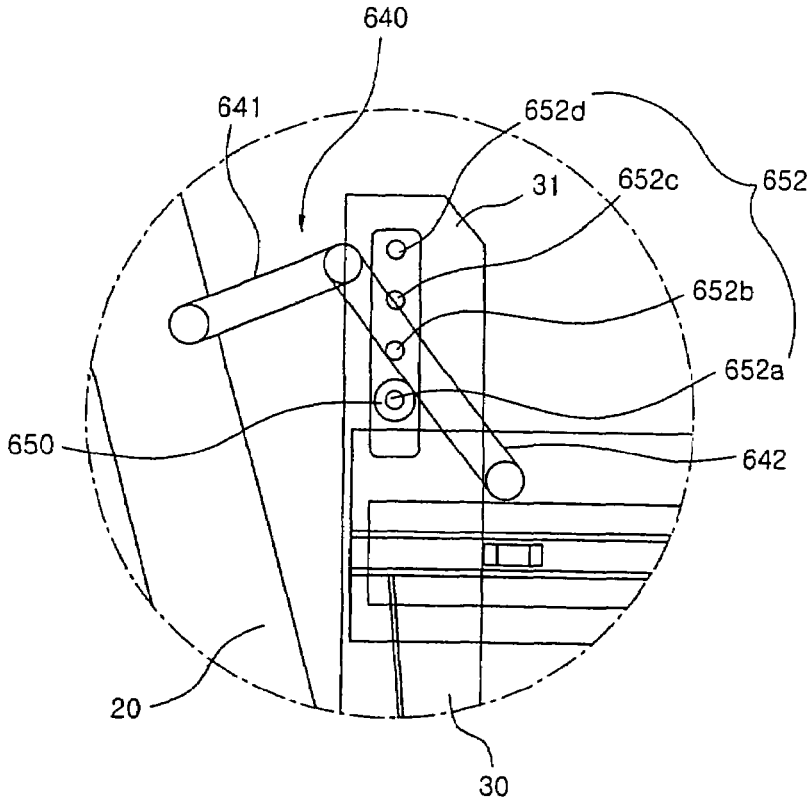
FIG. 15 is a partial side view showing the configuration of a still further embodiment of the present invention.
Figure 16:
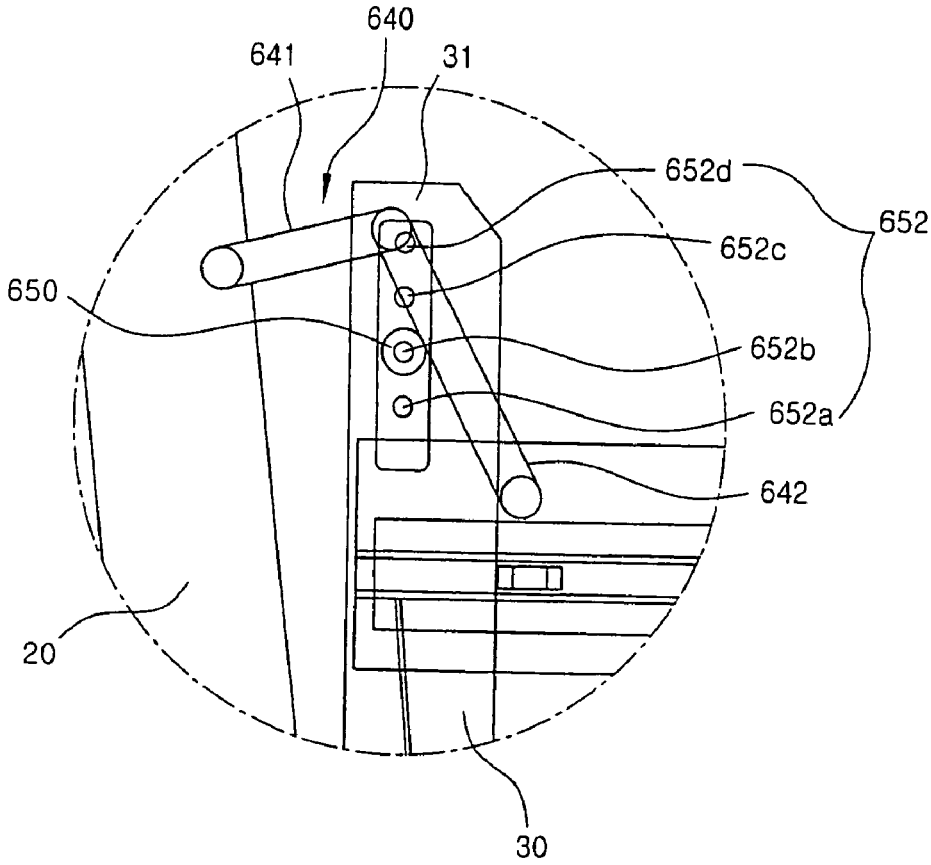
FIGS. 16 and 17 are views showing the use of the embodiment of FIG. 15.
Figure 17:
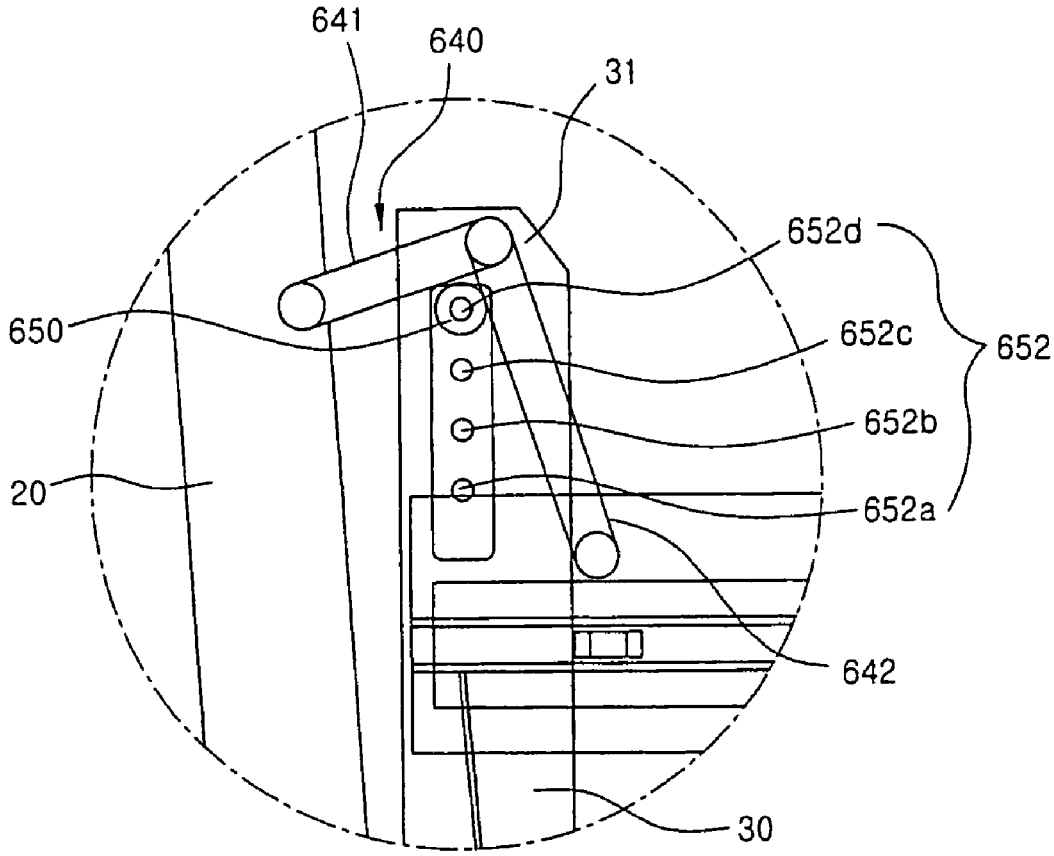

FIGS. 15 to 17 show a still further embodiment of the present invention. As shown in these figures, a connection link 640 is provided to connect the rear face of the door to the frame 30. The connection link 640 comprises a first link 641 and a second link 642 to be folded depending on the tilting of the door 20. It is preferred that connection links 640 be provided at both side ends of the door 20.

A selection screw 650 is provided in the side plate 31 of the frame 30. A general screw can be used as the selection screw 650. The side plate 31 of the frame 30 is perforated to form a plurality of selection holes 652 including selection holes 652*a*, 652*b*, 652*c* and 652*d* to which the selection screw 650 is fastened. The selection holes 652 are formed in the side plate 31 in such a manner that they are arranged at a predetermined interval in an up and down direction. The selection holes 652 have threads formed on inner peripheries thereof. Therefore, the selection screw 650 is selectively screwed into one of the selection holes 652.

The selection screw 650 is on a moving path of the second link 642 when it is fastened to one of the selection holes 652. Therefore, the movement of the second link 642 is limited depending on the position of one of the selection holes 652 to which the selection screw 650 is fastened. In such a way, the degree of tilting of the door 20 can be regulated. Here, it is preferred that a head of the selection screw 650 be sized to catch the second link 642 and made of a material capable of absorbing an impact to a certain extent without being easily damaged by the second link 642.

Meanwhile, if the user fastens the selection screw 650 to a lowermost one of the selection holes 652, the connection link 640 can be unfolded to a relatively large extent as shown in FIG. 15. Therefore, the degree of tilting of the door 20 becomes maximum.

Moreover, if the selection screw 650 is fastened to the selection hole 652*b* that is the second from below as shown in FIG. 16, the degree of unfolding of the connection link 640 is relatively decreased and thus the degree of tilting of the door 20 is also decreased.

If the selection screw 650 is fastened to the uppermost selection hole 652*d*, the amount of tilting of the door 20 becomes minimum as shown in FIG. 17. Alternatively, it is possible to design them in such a manner that the door 20 cannot be tilted if the selection screw 650 is fastened to the uppermost selection hole 652*d*.

The scope of the invention is not limited by the embodiments described above and is defined only by the appended claims. It will be apparent that those skilled in the art can make various modifications and changes thereto within the scope of the invention defined by the claims.

INDUSTRIAL APPLICABILITY

According to the present invention described above, it is possible to obtain the following advantages in the tiltable door apparatus for the drawer for the drawer type refrigerator.

First, since the user can select and utilize the tilting function of the door if desired, there is an advantage in that convenience of use is improved.

Further, since the door is closed by means of the elastic forces of the hinge units in the present invention, there is an advantage in that close contact of the door with the main body of the refrigerator is improved to prevent leakage of cold air.

Moreover, since the present invention employs the hinge units as the structure for tilting the door without using other structures for guiding the tilting of the door, the tilting operation of the door is not hindered by deformation of peripheral components and the like so that the reliability of the operation can be improved.

According to the present invention, since the shock-absorbing member is disposed between the door and the frame so that it can absorb an impact exerted by the door when the door that has been tilted returns to its original state, the impact exerted on the frame is minimized.

Finally, according to one embodiment of the present invention, since the user can select a variety of tilting angles of the door, there is convenience in properly tilting the door depending on conditions such as respective users or installation environments of the refrigerator.

The invention claimed is:

1. A refrigerator, comprising:

a main body;

a thermally insulated door slidably coupled to the main body;

a frame coupled to a rear face of the door such that the frame slidably moves together with the door relative to the main body;

a basket supported by the frame and detachably coupled to the frame, wherein the basket slides into and out of the main body together with the frame and the door; and a first rotatable coupler that rotatably couples the door to a front end of the frame so as to allow the door to selectively rotate through a predetermined angle with respect to the frame, wherein the first rotatable coupler comprises:

a first link and a second link, wherein proximal ends of the first link and the second link are rotatably connected to the door and the frame, respectively, and distal ends of the first link and the second link are rotatably coupled to each other;

a fastener that penetrates a first locking hole formed in the first link and is selectively inserted into a second locking hole formed in the frame such that the first link is positioned between an outer end of the fastener and the frame so as to regulate a tilting motion of the door relative to the frame; and a storage hole formed in the frame and configured to receive the fastener when the door is tilted away from the frame, wherein, when the fastener is inserted into the second locking hole after penetrating the first link, the door is in a vertical position and slides back and forth together with the frame, and wherein, when the fastener is received in the storage hole, the door is released from the frame so as to tilt relative to the frame, wherein an extent of tilt of the door is limited by the fastener.

2. The in refrigerator of claim 1, further comprising a shock absorber installed on the front end of the frame facing the rear face of the door.

3. The claim 1, wherein an angle between the first and second links increases as a tilting angle of the door relative to the frame increases, and the angle between the first and second links decreases as the tilting angle of the door relative to the frame decreases.

4. The in refrigerator of claim 1, further comprising a second rotatable coupler that rotatably couples a lower portion of the door to a lower portion of the frame, wherein the door rotates about an axis of rotation of the second rotatable coupler, and wherein the first rotatable coupler rotatably couples an upper portion of the door to an upper portion of the frame such that, as the door rotates about the axis of rotation of the second rotatable coupler, the upper portion of the door moves closer to or further away from the upper portion of the frame as the proximal and distal ends of each of the first and second links rotate.

5. The refrigerator of claim 1, wherein the fastener can be positioned to extend through the first locking hole and into the second locking hole so as to prevent movement of the door relative to the frame, and wherein, when the fastener is removed from the first and second locking holes, the door can move relative to the frame.

6. The refrigerator of claim 5, wherein the first and second links form a minimum angle when the fastener is positioned in the first and second locking holes.

7. The in refrigerator of claim 5, wherein the door is positioned against the frame and held in a substantially vertical position when the fastener is positioned in the first and second locking holes.

8. The refrigerator of claim 5, wherein the first and second links form a maximum opening angle when the fastener is removed from the first and second locking holes and the door is tilted with respect to the frame.

* * * * *